US005261582A

United States Patent [19]

Mathews et al.

[11] Patent Number: 5,261,582

[45] Date of Patent: Nov. 16, 1993

[54] BELT CASE FOR EYEGLASSES

[75] Inventors: John G. Mathews, Providence, R.I.; Richard W. Canavan, East Woodstock, Conn.

[73] Assignee: Uvex Safety, LLC, Smithfield, R.I.

[21] Appl. No.: 969,017

[22] Filed: Oct. 30, 1992

[51] Int. Cl.[5] ..... A45C 11/04

[52] U.S. Cl. ..... 224/240; 224/241; 224/245; 224/253; 206/5

[58] Field of Search ..... 224/224, 226, 240, 241, 224/242, 245, 253; 206/5, 6

[56] References Cited

U.S. PATENT DOCUMENTS

| | | | |
|---|---|---|---|
| 1,468,991 | 9/1923 | Butner | 224/253 X |
| 2,850,152 | 9/1958 | Marrufo | 224/253 X |
| 4,071,065 | 1/1978 | Halbich | 224/224 X |
| 4,865,186 | 9/1989 | Gates | 206/5 |
| 4,899,873 | 2/1990 | Bollé et al. | 206/5 |

*Primary Examiner*—Renee S. Luebke

*Attorney, Agent, or Firm*—Salter, Michaelson & Benson

[57] ABSTRACT

A belt case for a pair of eyeglasses is formed from a rigid and durable plastic for protecting the eyeglasses from damage. The case consists of front and rear rigid body sections which are receivable in interfitting engagement so that they cooperate to define an interior eyeglass compartment. The compartment is operative for retaining a pair of eyeglasses as well as a spare lens for the eyeglasses, and is further operative for individually retaining either the eyeglasses or the spare lens. The case is adapted to be mounted vertically on a wearer's belt and hingeably opened at the top end thereof to remove the eyeglasses and the spare lens. Both the spare lens and the eyeglasses are firmly retained in the case so that the lenses do not contact any interior surfaces of the case. The case also firmly retains the spare lens and eyeglasses so that they are not easily dislodged when the case is subjected to physical impacts.

9 Claims, 3 Drawing Sheets

BELT CASE FOR EYEGLASSES

BACKGROUND OF THE INVENTION

The instant invention relates generally to eyewear and more particularly to a rigid belt case for carrying and protecting a pair of eyeglasses.

It has been found that protective eyeglasses are increasingly being used in outdoor activities. Further, it has been found that these activities generally involve considerable physical activity in which the protective eyeglasses carried or worn by a particular individual are likely to be damaged. In many instances damage to eyeglasses occurs when they are not being worn, i.e. when they are folded and stored within a pocket or other compartment, such as a backpack. Damage to eyeglasses often occurs in such situations because the eyeglasses are not adequately protected when stored in such a manner. The lenses of the eyeglasses are particularly vulnerable to damage, and in this regard the lenses are frequently damaged with scratches and abrasions caused when the lenses come in contact with hard objects, such as keys, zippers, coins, etc. It has thus been determined that the use of a rigid case for carrying protective eyeglasses when not in use has particular advantages.

SUMMARY OF THE INVENTION

The instant invention provides a rigid belt case for carrying and protecting eyeglasses. The belt case is operative for retaining a pair of protective eyeglasses as well as a spare lens for the eyeglasses. The case is further operative for individually retaining the eyeglasses by themselves or the spare lens by itself.

Briefly, the belt case comprises front and rear rigid body sections which cooperate to define an interior compartment. The body sections have a top and bottom end and the case is adapted to be mounted vertically on a wearer's belt so that the top ends of the body sections face upwardly. The front and rear body sections are hingeably connected at the bottom ends thereof so that the top ends can be hingeably separated for easy access to the eyeglasses. The top ends of the body sections further include an interengaging tab and slot assembly for locking the body sections in a closed position. The front body section includes an arcuate front wall and a pair of side walls which extend rearwardly from the front wall. The rear body section includes a pair of angularly disposed rear wall sections and a pair of side walls which extend forwardly so as to interfittingly engage the side walls of the front body section on the inner sides thereof. The rear wall sections are angularly disposed so as to snugly fit against the hip contour of the wearer and one of the rear wall sections includes a pair of tubular channels in which belt clips or the like may be received for mounting the case on a wearer's belt. The side walls of the front and rear body sections are slidably receivable in snug engagement for effectively preventing dust and dirt from entering the interior compartment of the case. The case is constructed so that a spare lens can be retained in the interior compartment adjacent the front wall of the case. Specifically, a nose piece support and a rearwardly extending post are provided on the inside of the front wall. The spare lens includes a slot adjacent the upper edge thereof and a resilient nose piece attached to the lower nasal area thereof. To mount the spare lens in the case, the nose piece is frictionally received over the nose piece support inside the compartment and the slot is received onto the mounting post. This mounting arrangement effectively supports the spare lens in the case so that it is prevented from coming into contact with any surface, especially the front wall of the case, that could cause scratches to the lens. The case is further constructed so that the eyeglasses can be retained within the compartment adjacent the spare lens. The eyeglasses include a lens frame and a lens having an upper edge and a lower nasal area and a nose piece attached to the lower nasal area thereof. The lens is attached to the lens frame adjacent the upper edge thereof. To mount the eyeglasses in the case, the nose piece of the eyeglasses is received over the nose piece support. The case further includes a pair of locking blades which protrude inwardly from one of the side walls of the rear body section. When the body sections are moved into the closed position, the locking blades engage with the eyeglass frame so that it is firmly held in position between the terminal end of the mounting post and the locking blades.

Accordingly, it is an object of the instant invention to provide a belt case for carrying a pair of eyeglasses.

It is another object to provide a rigid belt case for a pair of eyeglasses which can protect the eyeglasses from scratches and abrasions, and further, which can hold the eyeglasses firmly therein to prevent any noise which may be caused by movement of the belt case.

It is yet another object to provide a belt case which is operative for retaining a pair of eyeglasses as well as a spare lens for the eyeglasses.

It is still another object to provide a means for firmly retaining a spare lens and a pair of eyeglasses within a belt case so that the eyeglasses are not easily dislodged from their mounted position when the case is subjected to physical impacts.

Further, it is yet still another object to provide a belt case which can protect a pair of eyeglasses from dust and dirt when not being worn.

Even further, it is an object of the instant invention to provide a belt case which is adapted to be vertically mounted on a wearer's belt and which includes hingeably connected front and rear sections which are adapted so as to hingeably open at top ends thereof.

Other objects, features and advantages of the invention shall become apparent as the description thereof proceeds when considered in connection with the accompanying illustrative drawings.

DESCRIPTION OF THE DRAWINGS

In the drawings which illustrate the best mode presently contemplated for carrying out the present invention.

DESCRIPTION OF THE INVENTION

Figure 1:
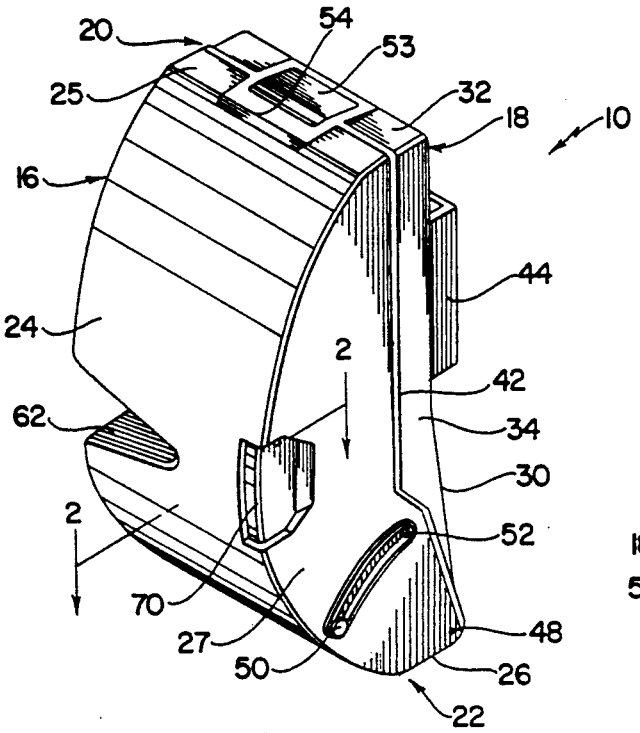
FIG. 1 is a perspective view of the belt case of the instant invention.

Referring now to the drawings, the eyeglass belt case of the instant invention is illustrated and generally indicated at 10 in FIGS. 1 through 5. The belt case 10 is operative for receiving and retaining a pair of protective eyeglasses generally indicated at 12 in FIG. 8, and a spare lens generally indicated at 14 in FIG. 7 for the eyeglasses. The belt case 10 comprises front and rear rigid body sections, generally indicated at 16 and 18 respectively, which are receivable in interfitting engagement so that they cooperate to define an interior compartment. The belt case 10 has top and bottom ends generally indicated at 20 and 22, respectively, and it is adapted to be mounted in a substantially vertical disposition on a wearer's belt (not shown). The front and rear body sections 16 and 18 are hingeably connected at the bottom end 22 of the case 10 so that the case 10 can be hingeably opened at the top end 20 thereof. The body sections 16 and 18 are preferably integrally molded by an injection molding process and they are formed from a plastic resin material which is durable, resistant to physical impacts, and resistant to chemicals at a wide range of temperatures.

The front body section 16 includes a generally arcuate front wall 24, a top wall 25, a bottom wall 26 and first and second side walls, 27 and 28, each of which extends rearwardly from the front wall 24.

The rear body section 18 includes a rear wall 30 comprising a pair of angularly disposed rear wall sections, a top wall 32 and first and second side walls 34 and 36, respectively, each of which extends forwardly from the rear wall 30 so as to be receivable in interfitting engagement inside the front body section 16. Specifically, the side walls 34 and 36 of the rear body sections 18 are slidably receivable in snug interfitting engagement with the sidewalls 27 and 28 of the front body section 16 to prevent dust and dirt from entering the interior compartment of the case 10. The first side wall 34 of the rear body section includes an enlarged section 38 adjacent the bottom end 22 thereof (see FIG. 4). The enlarged section 38 includes a front edge portion 40 and it is dimensioned so that the front edge portion 40 is receivable in closely spaced relation to the front wall 24 of the front body section 16 when the body sections 16 and 18 are in the closed position illustrated in FIGS. 1, 2 and 3. An external ridge 42 protrudes outwardly from the outer surface of the rear body section 18 for engaging the rear edges of the sidewalls 27 and 28 and top wall 25 of the front body section 16 to form a tight seal therebetween. This outer ridge 42 operates as a dust and dirt barrier and it further prevents dust and dirt from entering the interior compartment. The rear wall 30 includes a pair of angularly disposed rear wall sections so as to generally conform to the shape of a wearer's hip when the case 10 is worn in a vertical orientation, and it includes a pair of vertical tubular channels 44. The channels 44 are adapted so that belt clips (not shown) or the like can be extended through the channels 44 in order to mount the case 10 on a wearer's belt (not shown).

Figure 6:
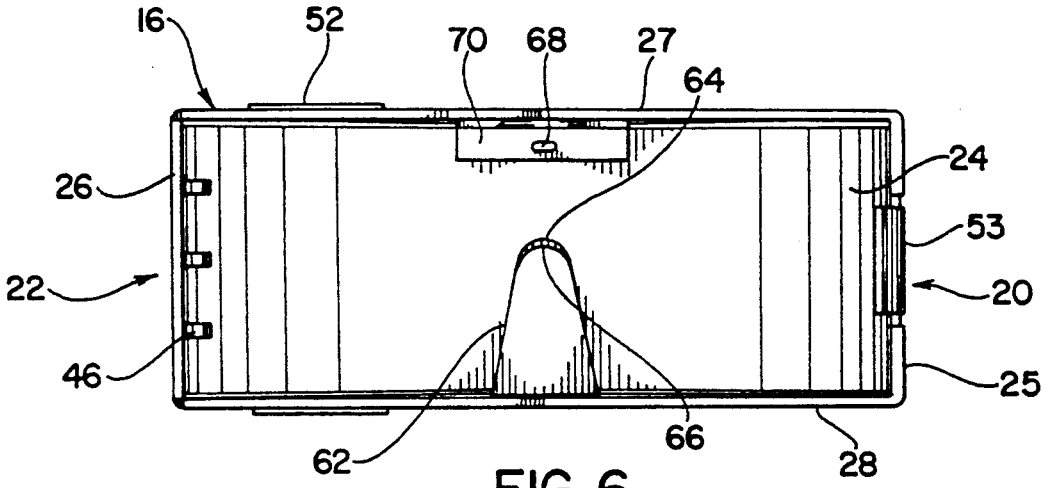
FIG. 6 is an elevational view of the inside of the front body section.
Figure 7:
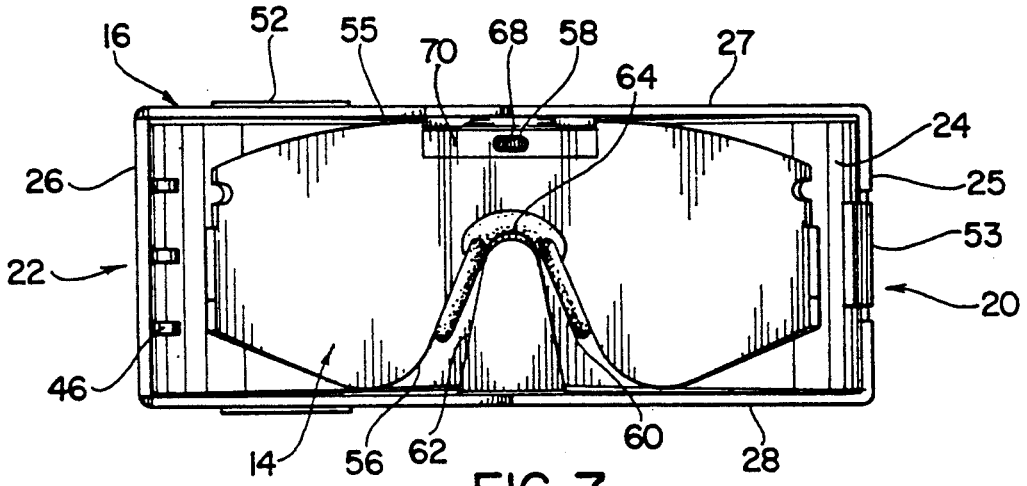
FIG. 7 is another elevational view of the front body section with a spare lens mounted therein.
Figure 8:
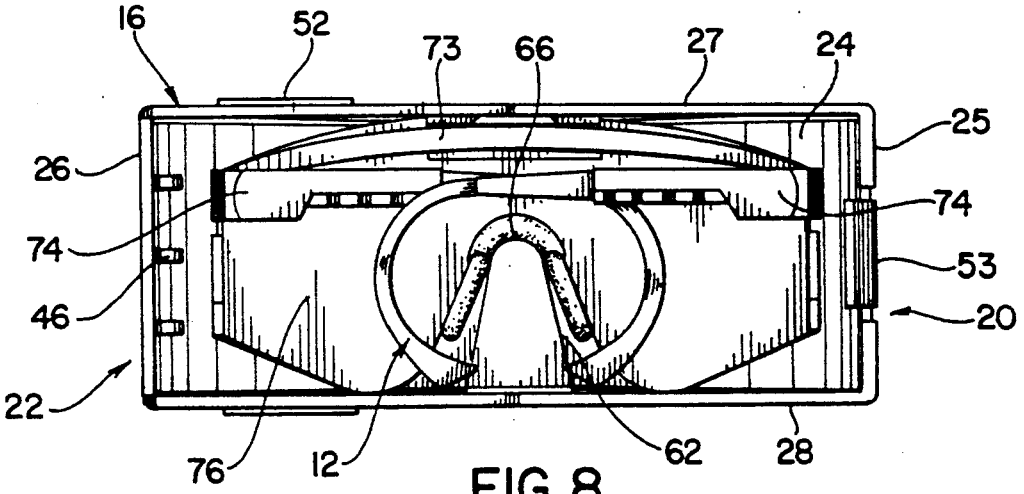
FIG. 8 is yet another elevational view of the front body section with a pair of eyeglasses mounted therein.

The front and rear body sections 16 and 18 are hingeably connected at the bottom end 22 of the case 10 by complementary hinge members 46 (FIGS. 6–8). A hinge pin 48 extends through the hinge members 46 to maintain the body sections 16 and 18 in hinged relation. The rear body section 18 includes a pair of guide posts 50 which extend outwardly from the side walls 34 and 36 thereof adjacent the bottom end 22. Also located adjacent the bottom end of the case 10 is a pair of arcuate guide slots 52 in the side walls 27 and 28 of the front body section 16 which cooperate with the guide posts 50 for restricting the amount by which the hinged body sections 16 and 18 are hingeable and for thereby defining the closed position illustrated in FIGS. 1, 2, and 3 and the open position illustrated in FIG. 4. At the top end 20 of the case 10, the top wall 25 of the front body section 16 includes a tab 53 and the top wall 32 of the rear body section 18 includes a slot 54. The tab 53 and the slot 54 are receivable in mating engagement to maintain the body sections 16 and 18 in the closed position.

Referring now to FIGS. 6 and 7, the case 10 is adapted for receiving the spare lens 14 in the interior compartment thereof adjacent the arcuate front wall 24 of the front body section 16. The spare lens 14 is generally arcuate in shape and it includes top and bottom edges 55 and 56 respectively, a small centrally located slot 58 adjacent the top edge 55 thereof and a resilient nose piece 60 attached to the bottom edge 56 thereof. A nose piece support 62 is integrally formed with the front body section 16 so that it extends rearwardly from the front wall 24 and inwardly from the second side wall 28. The nose piece support 62 includes an upper supporting portion 64 adjacent the front wall 24 for receiving the nose piece 60 of the spare lens 14 and an lower supporting portion 66 for receiving the eyeglasses 12 immediately behind the spare lens 14. An integrally formed mounting post 68 extends rearwardly from the inside of the front wall 24, the post 68 being dimensioned to be received in the slot 58 in the lens 14. The mounting post 58 extends rearwardly from a raised platform portion 70 which is integrally formed with the front wall 24 and the first side wall 26 of the front body section 16. It will be understood that when the spare lens 14 is received onto the post 58 and nose piece support 64, the lens 14 is maintained in spaced relation from the front wall 24 of the case 10 in order to prevent scratches and abrasions from contact therewith. When the body sections 16 and 18 are in the closed position, the spare lens 14 is further held in position by the terminal edge 40 of the rear body section 18 which urges the top edge 55 of the lens 14 against the raised platform 70 of the front body section 16 (See cutaway sections of FIG. 2 and 3). It is pointed out that the top edge 55 of the lens 14 is not visible When Wearing the eyeglasses 12 and therefore the effects of scratches or abrasions to the top edge 55 of the lens 14 caused by contact with the raised platform 70 and terminal edge 40 are minimal.

Figure 2:
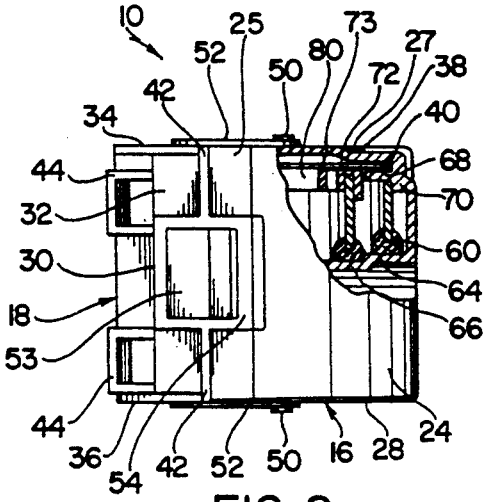
FIG. 2 is a top view thereof, partially in section, taken along line 2—2 in FIG. 1.
Figure 3:
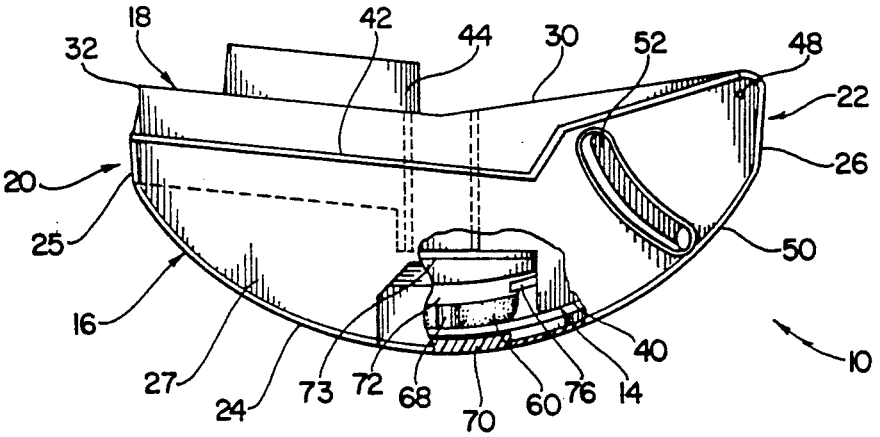
FIG. 3 is a side view thereof in a closed position.
Figure 4:
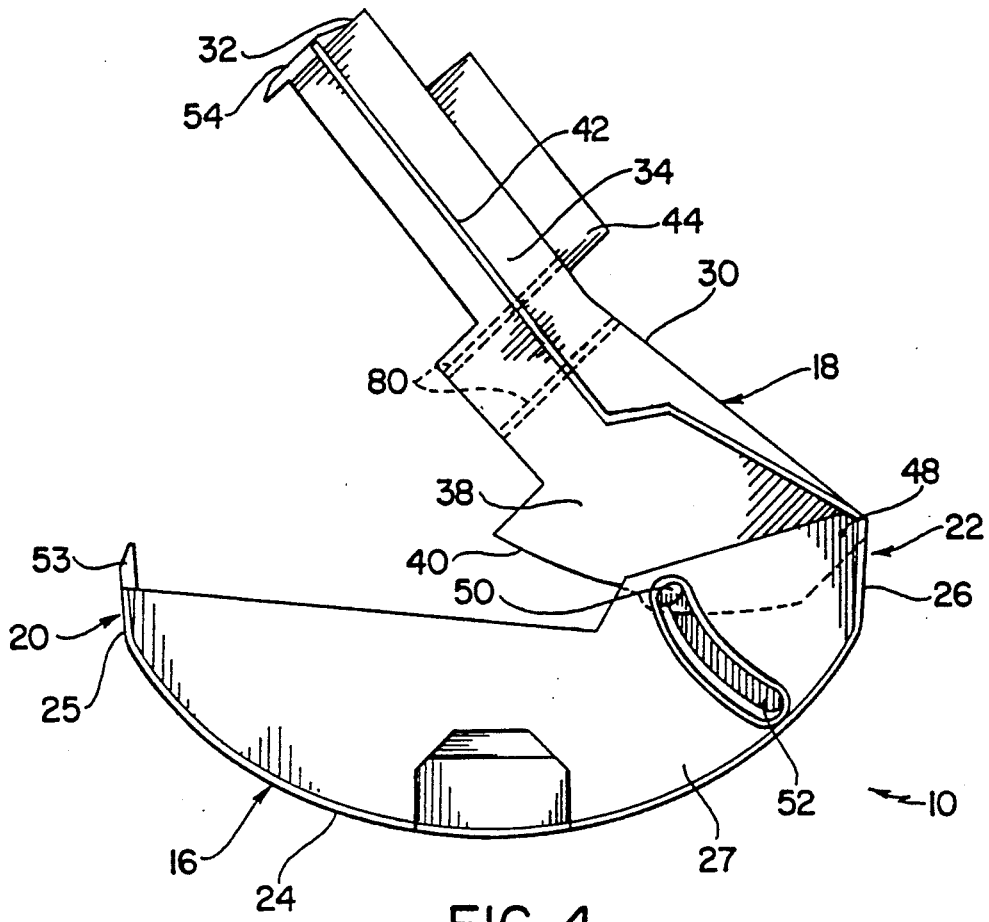
FIG. 4 is another side view thereof in an open position.
Figure 5:
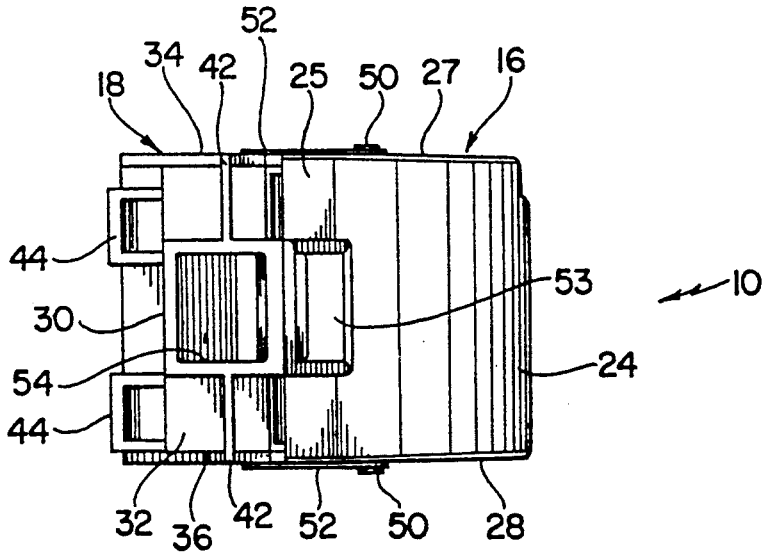
FIG. 5 is another top view thereof in a partially open position.

The eyeglasses 12 are receivable and securable in the interior compartment of the case 10 immediately rearward of the spare lens 14 (see FIGS. 2, 3 and 8). The eyeglasses 12 comprise a lens frame 72 including an integral brow bar 73, a pair of temple frames 74 hingeably connected to the lens frame 72 and a lens 76 attached to the lens frame 72. A resilient nose piece 78 is attached to the bottom edge of the lens 76. To mount the eyeglasses 12 in the case 10, the nose piece 78 of the eyeglasses is received onto the lower supporting portion 66 of the nose piece support 62. A pair of locking blades or ridges 80 ar provided projecting inwardly from the first side wall 34 of the rear body section 18 (See the cutaway sections of FIGS. 2 and 3 and broken lines in FIG. 4). When the body sections 16 and 18 are in the closed position, the lens frame 72 and the brow bar 73 are firmly retained between the terminal end of the mounting post 68 and the locking blades 80. In this manner, the frame 72 of the eyeglasses 12 is firmly held within the interior compartment of the case 10.

It is seen therefore that instant invention provides an effective belt case for carrying and protecting a pair of eyeglasses. The case 10 is effectively operative for retaining and protecting pair of protective eyeglasses as well as a spare lens for the eyeglasses. The case can also individually retain the eyeglasses 12 by themselves or the spare lens 14 by itself. The case 10 is adapted to be mounted vertically on a wearer's belt and it hingeably opens at the top end thereof for easy access to the interior compartment therein and removal of the eyeglasses therefrom. The case is formed from a durable plastic resin and it is constructed so as to effectively prevent damage, i.e., scratches, abrasions to the lens 76 of the eyeglasses 12 or the spare lens 14 carried therein. Further, in the event that the lens 76 of the eyeglasses 12 is damaged during use, the spare lens 14 is readily available for replacement of the damaged lens. Both the eyeglasses 12 and the spare lens 14 are firmly maintained in position inside the belt case compartment so that they are not easily dislodged when the belt case 10 is subjected to physical impacts. For all of these reasons, it is seen that the belt case 10 of the instant invention represents a significant advancement in the art which has substantial commercial merit.

While there is shown and described herein certain specific structure embodying the invention, it will be manifest to those skilled in the art that various modifications and rearrangements of the parts may be made without departing from the spirit and scope of the underlying inventive concept and that the same is not limited to the particular forms herein shown and described except insofar as indicated by the scope of the appended claims.

What is claimed is:

1. A belt case for a pair of eyeglasses comprising:

a body portion including front and rear rigid body sections which are receivable in interfitting engagement so that they cooperate to define an interior compartment, said body portion having a top end and a bottom end, said body sections being hingeably connected at said bottom end so that said body sections are hingeably moveable at said top end between an open position and a closed position;

latching means for releasably maintaining said body sections in said closed position;

means for mounting said body portion in a substantially vertical disposition on a belt of a wearer so that said top end is disposed upwardly; and support means on said front and rear body sections for rigidly supporting a pair of eyeglasses in a fixed position in said compartment when said body sections are in said closed position so that a lens portion of said eyeglasses does not contact said body portion.

2. In the belt case of claim 1, said front body section including a generally arcuate front wall, and a pair of side walls which extend rearwardly from said front wall, said rear body section including a rear wall and a pair of side walls which extend forwardly from said rear wall so that said rear body section side walls are slidably receivable in snug engagement with the side walls of said front body section.

3. The belt case of claim 2 further comprising means for retaining a spare eyeglass lens in closely spaced adjacent relation to said front wall of said front body section.

4. In the belt case of claim 2, said rear wall including said means for mounting said belt case on said belt.

5. In the belt case of claim 2, said support means comprising a nose piece support adjacent said front wall, a post extending inwardly from said front wall and a ridge extending inwardly from a side wall of said rear body section, said nose piece support being operable for receiving a nose piece of said eyeglasses, said post and said ridge being operable for retaining a row bar portion of said eyeglasses when said body sections are in said closed position.

6. In combination, a pair of eyeglasses;

a spare eyeglass lens including upper and lower edges, a resilient nose piece located adjacent said lower edge and a small centrally located slot adjacent said upper edge; and a belt case for supporting said pair of eyeglasses and said spare eyeglass lens comprising a body portion including front and rear rigid body sections which are receivable in interfitting engagement so that they cooperate to define an interior compartment, said front body section including a generally arcuate front wall, and a pair of side walls which extend rearwardly from said front wall, said rear body section including a rear wall and a pair of side walls which extend forwardly from said rear wall so that said rear body section walls are slidably received in snug engagement with the side walls of said front body section, said body portion having a top end and a bottom end, said belt case further including means for mounting said body portion in a substantially vertical disposition on a belt of a wearer so that said top end is disposed upwardly, means for retaining said pair of eyeglasses in said compartment; and means for retaining said spare eyeglass lens in said compartment comprising a mounting post extending rearwardly from said front wall and dimensioned to be received in said slot, said post terminating in a terminal end, and a nose piece support adjacent said front wall for frictionally receiving and supporting said nose piece.

7. In the combination of claim 6, said pair of eyeglasses being retained adjacent said spare lens.

8. In the combination of claim 7, said pair of eyeglasses including a lens frame portion having a brow bar, and a lens portion having an upper edge and a lower edge, said lens portion being attached to said lens frame portion at said upper edge thereof, said lens portion further including a resilient nose piece located adjacent the lower edge thereof, said means for retaining said eyeglasses comprising said nose piece support, said terminal end of said mounting post and a ridge extending inwardly from a side wall of said rear body section adjacent said lens frame portion when said pair of eyeglasses is received in said belt case, said nose piece support receiving and supporting said eyeglass nose piece, said brow bar being retained between said terminal end of said mounting post and said ridge when said body sections are in a closed position and said pair of eyeglasses is received in said belt case.

9. A belt case for supporting a pair of eyeglasses comprising:

a body portion including front and rear rigid body sections which are receivable in interfitting engagement so that they cooperate to define an interior compartment, said front body section including a generally arcuate front wall, and a pair of side walls which extend rearwardly from said front wall, said rear body section including a rear wall comprising a pair of angularly disposed wall sections, and a pair of side walls which extend forwardly from said rear wall so that said rear body section side walls are slidably received in snug engagement with the side walls of said front body section, said body portion having a top end and a bottom end;

means for mounting said body portion in a substantially vertical disposition on a belt of a wearer so that said top end is disposed upwardly;

means for retaining a pair of eyeglasses in said compartment; and means for retaining a spare eyeglass lens in said compartment.

* * * * *